US008047806B2

(12) United States Patent
Liang et al.

(10) Patent No.: US 8,047,806 B2
(45) Date of Patent: Nov. 1, 2011

(54) JET WELL PUMP

(75) Inventors: Yuanmin Liang, Yangjiang (CN); Dongxian Liang, Yangjiang (CN); Chunyuan Huo, Beijing (CN)

(73) Assignee: Guangdong Winning Pumps Industrial Co., Ltd., Yangjiang, Guangdong (CN)

( * ) Notice: Subject to any disclaimer, the term of this patent is extended or adjusted under 35 U.S.C. 154(b) by 723 days.

(21) Appl. No.: 12/158,874

(22) PCT Filed: Mar. 30, 2006

(86) PCT No.: PCT/CN2006/000549

§ 371 (c)(1), (2), (4) Date: Sep. 8, 2008

(87) PCT Pub. No.: WO2007/073633

PCT Pub. Date: Jul. 5, 2007

(65) Prior Publication Data

US 2009/0297366 A1 Dec. 3, 2009

(30) Foreign Application Priority Data

Dec. 29, 2005 (CN) ..... 2005 1 0121427

(51) Int. Cl.

| | |
|---|---|
| ***F04B 23/04*** | (2006.01) |
| ***F04B 23/00*** | (2006.01) |
| ***F04F 5/00*** | (2006.01) |
| ***F04F 5/54*** | (2006.01) |

(52) U.S. Cl. ..... 417/80; 417/313; 417/151; 417/84

(58) Field of Classification Search ..... 417/80–84, 417/313, 151–198

See application file for complete search history.

(56) References Cited

U.S. PATENT DOCUMENTS 4,565,489 A 1/1986 Haide (Continued)

FOREIGN PATENT DOCUMENTS

CN 87215362 U 12/1988

(Continued)

OTHER PUBLICATIONS

International Search Report issued in parent PCT Application No. PCT/CN2006/000549 (including English translation) (5 pages), Jun. 15, 2006.

(Continued)

*Primary Examiner* — Mariceli Santiago

(74) *Attorney, Agent, or Firm* — Wood, Herron & Evans, LLP

(57) ABSTRACT

An improved jet well pump includes a centrifugal pump assembly that is a stamping-welding one and a jet pump assembly. The centrifugal pump assembly includes a pump body and a pump cover, an impeller and a shaft that are disposed in the pump body, it also includes a motor arranged outside of the pump body. The impeller is installed on the shaft and driven by the motor. The jet pump assembly includes a jet pump body, a nozzle installed in the jet pump body and a throat member disposed on the upper end of the jet pump body. The centrifugal pump assembly and the jet pump assembly are communicated with each other by means of an inlet pipe and a return pipe. The upper ends of the inlet pipe and the return pipe are connected with an inlet and an outlet that are arranged on the axial surface of the pump body respectively, and the lower ends are connected with the throat member and the jet pump body respectively. The well pump not only improves manufactural process by simplifying and compacting structure and is convenient for transportation and use, but also reduces the intensity of labor and the cost, saves materials and has no pollution.

18 Claims, 4 Drawing Sheets

U.S. PATENT DOCUMENTS 5,018,946 A * 5/1991 Breckner et al. ..... 417/197
5,074,759 A * 12/1991 Cossairt ..... 417/198

FOREIGN PATENT DOCUMENTS

CN 2078386 U 6/1991
CN 2231721 Y 7/1996
CN 2308738 Y 1/1999
CN 2308742 Y 2/1999
CN 2357158 Y 1/2000
JP 9296780 11/1997

OTHER PUBLICATIONS

English translation of the International Preliminary Report on Patentability issued in parent PCT Application No. PCT/CN2006/000549 (4 pages), Nov. 6, 2007.

* cited by examiner

JET WELL PUMP

FIELD OF THE INVENTION

The present invention relates to a water pump, more particularly, to an improved jet well pump manufactured from metal plate by stamping.

BACKGROUND OF THE INVENTION

Well pump is a kind of general mechanism and widely used in many fields. The pump, adapted to set device above water level, mainly includes two types, one is submersible pump and the other is well pump.

Working principle of the submersible pump is: an electrical motor for the submersible pump is a submersible motor; both of pump body and electrical motor are under water during working. Therefore it has high requirement for sealing ability of the motor and it causes high cost and difficulty of maintaining. Furthermore, the submersible pump has a larger radial size, so its range of usage is restricted because it can not be put into some well with small radial size.

There are two kinds of well pump: multistage well pumps and jet well pumps. A pump body and an electrical motor of the multistage well pump are separated, the pump body is adopted a multistage centrifugal pump which is submersible, and the electrical motor is disposed on ground. A coupler is installed between the pump body and the electrical motor, usually the shaft of the pump is segmentary connected due to its long length. Therefore, this pump not only requires highly accuracy of manufacture and high cost, but it also has problems of complex installation, high failure rate and difficulty of maintaining, and it is hard to be widely applied.

Therefore, jet well pump has been a primary pump used for deep pumping. However, state of the art jet well pumps present some drawbacks. A jet well pump assembly was disclosed in Chinese utility model CN2231721 (App. No. 95218415.X), this assembly includes an electrical motor assembly arranged on external well, a jet pump assembly arranged inside of the well and a connection pipe between both of them. Wherein the jet pump assembly includes a jet pump, a filter pipe, a check valve, a vacuum meter and connecting pipe; the electrical motor assembly includes a base, a centrifugal pump, a circulation water tank, a pressure meter and valves of inlet and outlet. The circulation water tank and the centrifugal pump are mounted on the base, and connected by a connection pipe. The centrifugal pump and the jet pump are connected by a connecting pipe, i.e. return pipe, which forms a high pressure flow filled into the jet pump and ejected out through a nozzle of the jet pump; a connection pipe (i.e. inlet pipe) is also disposed between the water tank and the jet pump, the flow ejected from the nozzle enters in the water tank through this pipe. Thereby, such jet well pump assembly not only makes the total size of the system huge which bring inconveniences on transport and usage, but it also increases the cost due to installation of circulation water tank and other accessories (such as the connection pipes, the pressure meter, the valves of inlet and outlet).

Another Chinese utility model CN2308738 disclosed a Spray-sucking deep well water pump. This well pump includes an electrical pump with an auto-sucking screw pump, an inlet valve, a water tank, a pressure meter, a pressure controlling outlet valve, Spray-sucking head and bottom valve, an inlet and outlet of the Spray-sucking head, i.e. jet pump, respectively connected to an inlet and outlet of the electrical pump with an auto-sucking screw pump through an inlet pipe and a high pressure return pipe. Although this jet well pump eliminates a circulation water tank existed in the prior art, which increases its flexibility, however there is a store tank to increase the water pressure of the return pipe, because that it is necessary to compensate the insufficiency of pressure for ejection of using the electrical pump with an auto-sucking screw pump; on the other hand, an upper portion of the inlet pipe is connected to the inlet pipe of the electric pump with an auto-sucking screw pump (not a body of the pump), which increases a complexity of structure and causes there is no enough suction power inside of the inlet pipe so as to decrease total water power of the pump.

Furthermore, usually each part of the jet well pumps in the prior art is manufactured by casing, which causes problems of huge size, heave weight and absence of flexibility. On the other hand, the casing is a process having problems of high consuming of electricity and material, intensity of labor and unfriendly influence for environment; and casing process also can not make some components for those smaller centrifugal pumps, such like an impeller having a narrow outlet and small flow rate, due to restriction of size and structure.

SUMMARY OF THE INVENTION

The present invention is directed to solve the problems exiting in the prior art, accordingly, provides a jet well pump which has many advantages, such as simple and compact structure, convenient transfer, simple manufacture process, non-pollution, material save and cost dramatically decreasing.

According to the present invention, there is provided an improved jet well pump, comprises: a centrifugal pump assembly, which is a centrifugal pump manufactured by stamping-welding, and a jet pump assembly; said centrifugal pump assembly comprises a pump body, a pump cover mounted inside of said pump body, an impeller, a shaft, and an electrical motor provided outside of the pump body, said impeller is mounted on said shaft and driven by said motor; said jet pump assembly comprises: a jet pump body; a nozzle mounted in said jet pump body; and a throat member disposed on the upper end of said jet pump body; said centrifugal pump assembly and said jet pump assembly communicated with each other by means of an inlet pipe and a return pipe, upper ends of said inlet pipe and the return pipe connected with an inlet and an outlet that are arranged on an axial surface of the pump body respectively, and lower ends of said inlet pipe and the return pipe connected with said throat member and said jet pump body respectively.

The improved jet well pump according to the present utility mode also has additional technical characters as following:

A radial shape of said pump body is a full spiral gradually increasing along with a radial-outward direction of fluid flow, a section plane of the radial shape is an isosceles trapezoid having a slope in smooth variety, an inclination of said isosceles trapezoid $\beta$ increasing as a radial depth of said pump body increasing, with a range between 20° and 85°.

A radial surface of said pump body has an outlet pipe connecting a start point and an end point of said spiral.

A diameter of said return pipe is less than or equal to a diameter of said outlet pipe, said diameter of said outlet pipe is less than or equal to a diameter of said inlet pipe.

Said pump body also having a water filling hole, which is disposed on a higher position than both of said inlet and said outlet, and a water discharge hole disposed on lower portion of said pump body.

Said inlet is disposed in a center of said pump body's axial surface; said outlet is disposed between said inlet and edge of said axial surface and parallel with said inlet.

Said outlet is disposed on an area between 90° and 270° of said spiral.

Said outlet is disposed on a 90° position of said spiral, a height of said position equaling to a height of said inlet.

The upper end of said return pipe is connected to said outlet arranged on the axial surface of the pump body by a mean of thread fit, the lower end of said return pipe is connected to a return hole of said jet pump body by a mean of thread fit; the upper end of said inlet pipe is connected to said inlet arranged on the axial surface of the pump body by a mean of thread fit, the lower end of said inlet pipe is connected to an upper end of said throat member by a mean of thread fit.

The axial surface of said pump body is a spherical plane or a curved plane with a variable curvature.

A bracket is disposed inside of said pump body, one end of said bracket is fitted over and fixed on an internal end of said inlet, the other end of which is fixed on an internal side of the axial surface of said pump body; a gland cover is arranged on the internal end of said inlet, a seal ring is disposed in said gland cover, a radial clearance between said seal ring and a front cover of said impeller is less than 0.3 mm.

Said impeller comprises a front cover, a rear cover and a spiral blade disposed between said front cover and said rear cover, three of them manufactured from metal plate by stamping, and then welded together.

Said nozzle has a cone-shape which peak is upward, a diameter of said nozzle gradually decreases along with a direction of fluid flow.

Said throat comprises, connected in turn, a diversion portion, a first stabilizing pressure portion, a diffusion portion and a second stabilizing pressure portion, both lengths of said first stabilizing pressure portion and said second stabilizing pressure portion more than or equal to internal diameter thereof, a angle of said diffusion portion a for enlarging pressure less than or equal to 10°. A front end of said nozzle extends into said diversion portion of said throat, the axial distance between said nozzle and said first stabilizing pressure portion is less than or equal to the minimum diameter of said nozzle.

Said jet pump assembly also comprises a bottom valve provided on bottom of said jet pump body and a filter disposed on bottom of said bottom valve.

The improved jet well pump according to the present invention has the following advantages: firstly, the centrifugal pump assembly and the jet pump assembly are communicated with each other by means of an inlet pipe and a return pipe, which forms a direct water circle between the two assemblies, thereby a circulation water tank of the prior art can be removed, so that the overall structure of the jet well pump is dramatically simplified, which causes the cost decreasing, the transfer easier and the convenient using. Secondly, because that the upper ends of said inlet pipe and the return pipe are directly connected with an inlet and an outlet that are arranged on an axial surface of the pump body, which reduces the pressure loss of reflux in maximum and increases a water pressure and a suction respectively in the return pipe and the inlet pipe, therefore, it enhances the height of pumping water (can reach over 30 meter) and efficiency of the pump. Thirdly, the pump has some advantages, such like lower cost, material save, easily maintaining, reliable operation and simple structure, which can not be seen in cast pump, due to its centrifuge pump assembly manufactured by stamping-welding.

BRIEF DESCRIPTION OF THE DRAWINGS

Therese and other aspects and advantages of the invention will become apparent and more readily appreciated from the following descriptions taken in conjunction with the drawings in which.

DETAILED DESCRIPTION

Figures 1, 1A:
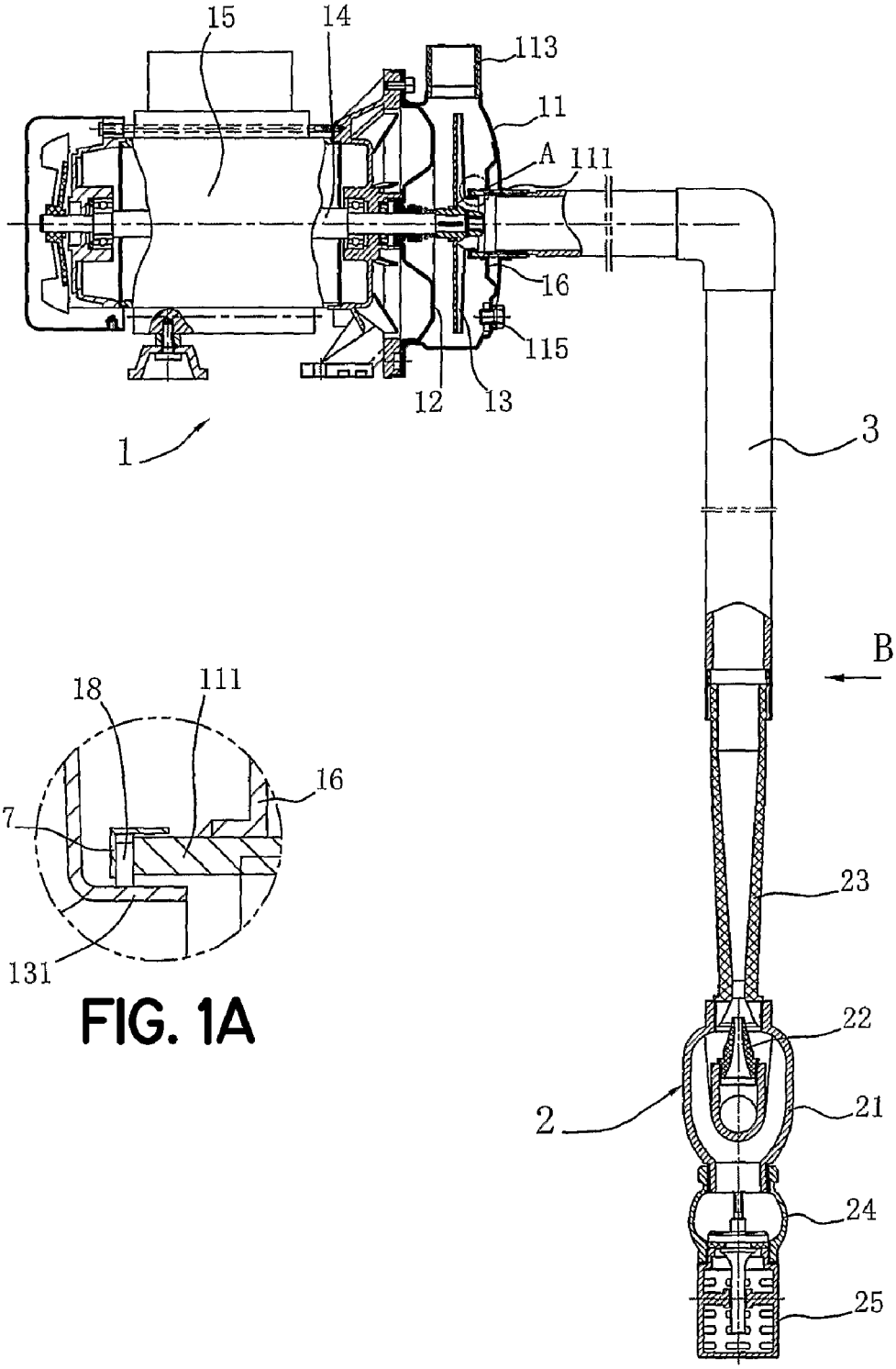
FIG. 1 is a schematic front view of the improved jet well pump according to the present invention, where a partial sectional view is adapted to illuminate the specific structure of the centrifuge pump assembly and jet pump assembly.
FIG. 1A is a partial enlargement view of the area A in FIG. 1, in which it illuminates the structure of the gland cover and the seal ring, and the configuration of the front cover.

As shown in FIG. 1, the improved jet well pump according to the present invention comprises a centrifugal pump assembly 1 which is a centrifugal pump manufactured by stamping-welding and a jet pump assembly 2; said centrifugal pump assembly comprises a pump body 11, a pump cover (12) mounted into said pump body 11, an impeller 13, a shaft 14 disposed in said pump body 11 and an electrical motor 15 arranged outside of the pump body 11, said impeller 13 is mounted on said shaft 14 and driven by said motor 15; said jet pump assembly 2 comprises a jet pump body 21, a nozzle 22 mounted in said jet pump body 21, a throat member 23 disposed on the upper end of said jet pump body 21, a bottom valve 24 provided on bottom of said jet pump body 21 and a filter 25 disposed on bottom of said bottom valve 24. Because the centrifugal pump taking a process of stamping-welding to manufacture is being the centrifugal pump assembly 1, it not only overcomes disadvantages of the cast pump, such like large power and material consuming and pollution, but it also has virtues of lower cost, material save, easily maintaining, reliable operation and simple structure etc.

Figure 2:
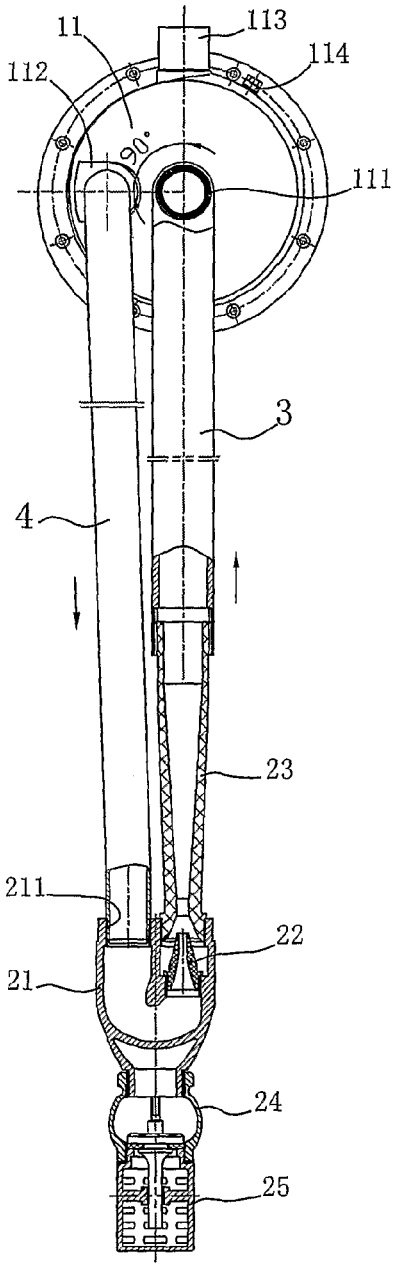
FIG. 2 is a view along with B direction in the FIG. 1, it illuminates the locations of the inlet pipe and return pipe.

As shown in FIG. 2, said centrifugal pump assembly 1 and said jet pump assembly 2 are communicated with each other by means of an inlet pipe 3 and a return pipe 4. The upper ends of said inlet pipe 3 and said return pipe 4 are connected with an inlet 111 and an outlet 112 arranged on an axial surface of the pump body 11 respectively, and the lower ends of the inlet pipe 3 and the return pipe 4 are connected with said throat member 23 and said jet pump body 21 respectively. Therefore, a water circulation is directly formed between said centrifugal pump assembly land said jet pump assembly 2, so that it is possible to remove a water circulation tank in the prior art, which not only simplifies an overall structure of the jet well pump and reduces the cost, but it also make easier in ways of transfer and using.

In a preferred embodiment of the present invention, the upper ends of said inlet pipe 3 and said return pipe 4 are connected with an inlet 111 and an outlet 112 by means of thread fit; the lower ends of the inlet pipe 3 and the return pipe 4 are connected with said throat member 23 and the return hole 211 of said jet pump body 21 by means of thread fit. The thread fit can ensure a reliable connection; especially it is suitable for small size pump. Because the upper ends of said inlet pipe 3 and the return pipe 4 are connected with an inlet 111 and an outlet 112 that are arranged on an axial surface of the pump body 11 directly, some ancillary connection pipe can be eliminated, which makes the total configuration of the jet well pump more compact and simpler and reduces the cost of manufacture. On the other hand, the water in said return pipe 4 has higher pressure due to such direct connections. Moreover, due to the pumping action inside of the inlet 111 of said pump body 11 and the pressure action of said jet pump, a suction force is produced inside of said inlet pipe 3, hence, it enhances the height of pumping water (can reach over 30 meter) and efficiency of the pump. For reducing the pressure loss of reflux in maximum, the outlet 112 is arranged on the axial surface of said pump body 11, thereby, the water returning to said jet pump assembly 2 through said return pipe 4 has quite high pressure, so as to increase the height of pumping water.

Figure 3:
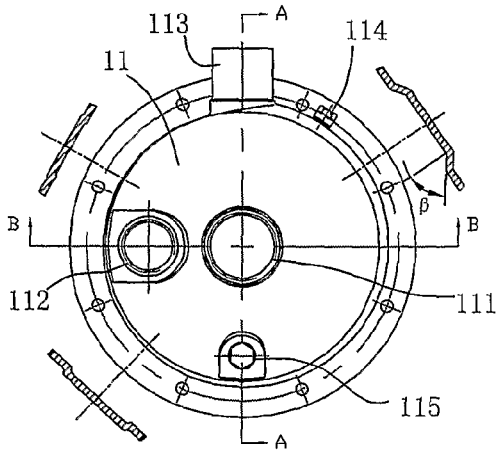
FIG. 3 is a side view of the centrifugal pump body of the jet well pump, it illuminates the locations of the inlet, the outlet, the vertical outlet, filling hole and discharge hole, there are also three partial sectional views showing variation rule of the pump's chamber.
Figure 4:
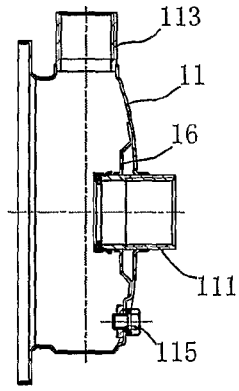
FIG. 4 is a sectional view of the pump body taken along line A-A in FIG. 3.
Figure 5:
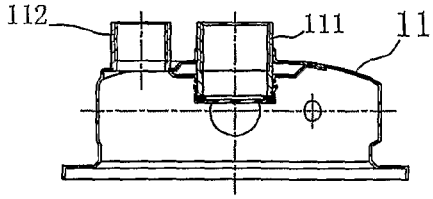
FIG. 5 is a sectional view of the pump body taken along line B-B in FIG. 3.
Figure 6:
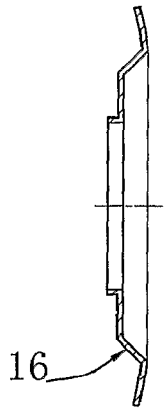
FIG. 6 is an enlargement sectional view of the bracket for seal ring of internal end of the inlet.

As shown in FIG. 2 and FIG. 3, a radial shape of said pump body 11 is a full spiral gradually increasing along with a radial-outward direction of fluid flow, a sectional plane of the radial shape is an isosceles trapezoid having a slope in smooth variety, an inclination of said isosceles trapezoid $\beta$ increase as a radial depth of said pump body increasing (illuminated by the three partial section views in FIG. 3), with a range between 20° and 85. The chamber having such structure simultaneously increases in a smooth way along with both radial and an axial direction, which leads water fluently flowing, the efficiency higher and manufacture of the pumps easier. The inclination $\beta$ within the range can enhance the flowing ability of the water and make the process of manufacture simple. As shown in FIG. 1, FIG. 4 and FIG. 5, the axial plane of said pump body 11 is a spherical plane or a curved plane with a variable curvature. Hence, this design enables an improvement of rigidity and strength of said pump body 11 and the flowing ability of the water, so as to improve hydraulic efficiency.

As shown in FIG. 1 and FIG. 2, said vertical outlet 113 disposed on the radial surface of said pump body 11 is connected a start point with an end point of said spiral. The diameter of said outlet 112 is less than or equal to the diameter of said vertical outlet 113, the diameter of said vertical outlet 113 is less than or equal to the diameter of said inlet 111. A part of liquid flowing into said pump body 11 through said inlet 111 flow out of said jet well pump through said vertical outlet 113, but the other liquid flow back to said jet pump body 21 through said outlet 112. Therefore, the sizes of these three diameters are possible to ensure the liquid flowing from said outlet 112 to have enough pressure.

As shown in FIG. 3, said pump body 11 also has a water filling hole 114 disposed on a higher position than both of said inlet 111 and said outlet 112 and a water discharge hole 115 disposed on lower portion of said pump body 11. Said water filling hole 114 is used for filling water into pump body 11 before start of the jet well pump; said water discharge hole 115 is used for discharging water after shut down the jet well pump.

As shown in FIG. 3 said inlet 111 is disposed in the center of said pump body's axial surface, said outlet 112 is disposed between said inlet 111 and the edge of said axial surface, and parallel with said inlet 111. This structure makes the manufacture of the pump body 11 easy and the assemblies convenient, such like between said inlet 111, said outlet 112 and said pump body 11, between said inlet 111 and said inlet pipe 3, and between said outlet 112 and said return pipe 4.

In the present invention, said outlet 112 is disposed on an area between 90° and 270° of said spiral. The reasons of such arrangement is that it is good for ensuring enough pressure for the return water and making it easy to connect said outlet 112 with said return pipe 4 and connect said return pipe 4 with said jet pump body 21.

As shown in FIG. 2 and FIG. 3, in a preferred embodiment of present invention, said outlet 112 is arranged in a position equal to the height of said inlet 111, i.e. in the 90° position of the spiral.

As shown in FIG. 1, FIG. 4, FIG. 5 and FIG. 6, a bracket for seal ring of internal end of said inlet 16 is disposed in said pump body 11, an end of said bracket 16 is fitted over and fixed on an internal end of said inlet 111, the other end of which is fixed on an internal side of the axial surface of said pump body 11, such like by welding. Said bracket can support said inlet 111 and can increase the rigidity and strength of said pump body 11.

Figure 7:
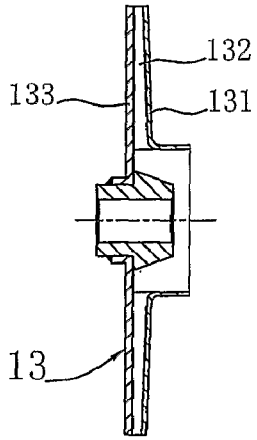
FIG. 7 is an enlargement view of the impeller of the centrifugal pump assembly according to the present invention, for an easy understanding, a hub installed in the middle of the impeller is also illuminated.

As shown in FIG. 1 and FIG. 7, an impeller 13 comprises a front cover 131, a rear cover 132 and a spiral blade 133 disposed between said front cover and said rear cover, three of them are manufactured from metal plates by stamping, and welded together. Therefore, the cost of manufacture is reduced.

As shown in FIG. 1A, a gland cover 17 is arranged on the internal end of said inlet 111, a seal ring 18 is disposed in said gland cover 17, a radial clearance between said seal ring 18 and a front cover of said impeller 14 is less than 0.3 mm. Thereby, it provides some advantages, such like obtaining a quality sealing effect, an accurate controlling of reverse flow, a reduced leakage and ensuring the flow rate and pump lift, so as to increase the efficiency of the pump.

Figure 8:
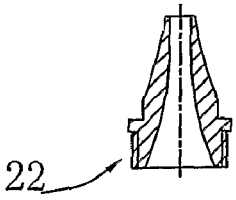
FIG. 8 is an enlargement view of the nozzle of the jet pump assembly.

As shown in FIG. 8, said nozzle 22 of said jet pump assembly 22 has a cone shape whose peak is upward; the diameter of said nozzle gradually decreases along with a direction of fluid flow, which guarantees a high jetting pressure of water.

Figure 9:
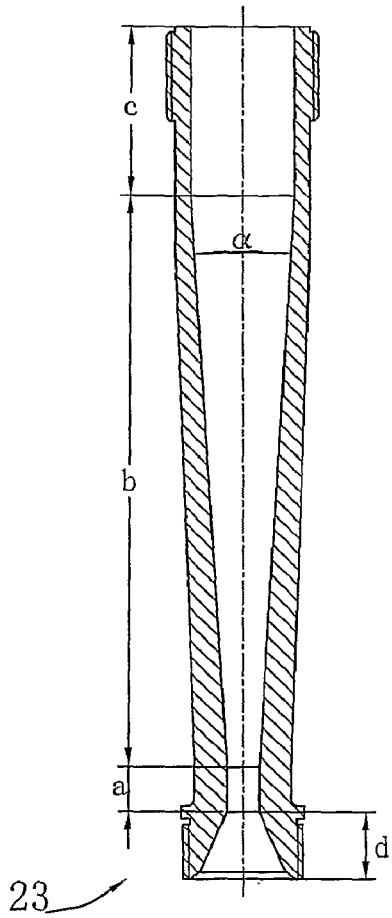
FIG. 9 is an enlargement view of the throat member of the jet pump assembly, further, the structure and the components thereof are illuminated.

As shown in FIG. 9, said throat 23 comprises a diversion portion "d", a first stabilizing pressure portion "a", a diffusion portion "b" and a second stabilizing pressure portion "c" which are connected in turn, both lengths of said first stabilizing pressure portion "a" and said second stabilizing pressure portion "c" are more than or equal to internal diameter thereof, a angle of said diffusion portion a for enlarging pressure is less than or equal to 10°. The angle $\alpha$ less than or equal to 10° is good for the diffusion of water and reducing the loss of hydraulic efficiency in diffusion. A front end of said nozzle 22 extends into said diversion portion "d" of said throat 23, an axial distance between said nozzle and said first stabilizing pressure portion "a" is less than or equal to the minimum diameter of said nozzle 22. Hence, the liquid flow jetted from said nozzle 22 is ejected to said first stabilizing pressure portion "a" through said diversion portion "d", then is flowed to said inlet pipe 3 through said diffusion portion "b" and second stabilizing pressure portion "c".

Figure 12:
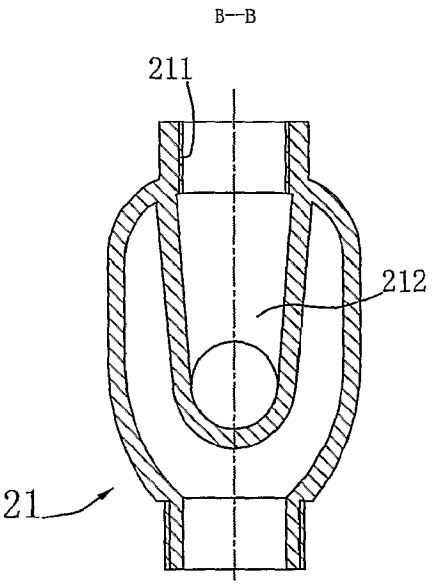
FIG. 12 is a sectional view taken along line B-B in the FIG. 10, further, it illuminates the internal structure of the jet pump's body.
Figure 11:
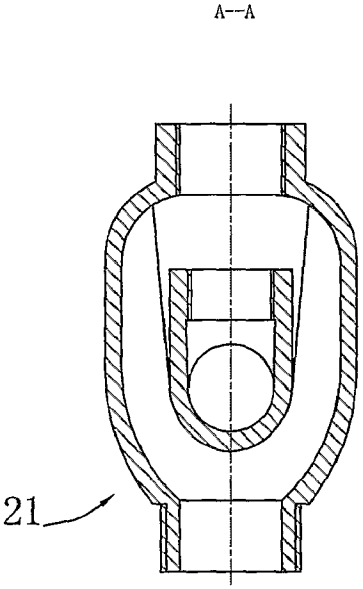
FIG. 11 is a sectional view taken along line A-A in the FIG. 10, further, it illuminates the internal structure of the jet pump's body.
Figure 10:
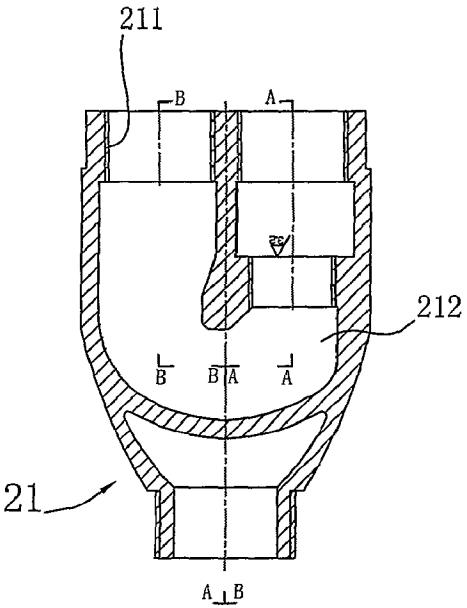
FIG. 10 is an enlargement sectional view of the pump body of the jet pump.

As shown in FIG. 10, FIG. 11 and FIG. 12, a return hole 211 connected to said return pipe 4 is disposed on the upper portion of said jet pump body, and a suction chamber 212 is formed in the middle thereof.

The working principle of the present invention is: Water is filled up the pump body 11 by the water filling hole 114 before starting of the jet well pump. Then starting the centrifugal pump, and the water inside of the centrifugal pump becomes high pressure liquid flow under the impeller action, a portion of the water flow is ejected out of the vertical outlet 113, however, the other water flow flows to the jet pump body 21 through the outlet 112 and the return pipe 4, then flows to the nozzle 22 through the circular suction chamber 212 of the jet pump body 21, finally the other water flow is ejected by the nozzle 22. Due to the high speed action of water flow, the pressure around the suction chamber 212 is dramatically reduced, so as to form negative pressure, therefore, the external water flow is pumped to the suction chamber 212 through the filter 25 and bottom valve 24, and is joined in the high pressure water flow, then flow together to the throat member 23 through the diversion portion "d" of the throat member 23; on the other hand, due to the formation of negative pressure inside the inlet 111, there is also a pumping force. Hence, the water in a well is pumped to the inlet pipe 3 under the actions of the pumping force inside the inlet 111 and the pressure of the high pressure water flow; the water inside the inlet pipe 3 enters to the impeller 13, then the water obtained power from the impeller 13 flows in the pump body 11, in the pump body 11, a portion of the water having kinetic energy and pressure energy flows out of the vertical outlet 113, and other water flows to the jet pump body 21 again through the outlet 112 and the return pipe 4, a circulation is formed by repeating the above actions, so that the water in a well can be continuously pumped and ejected.

The improved jet well pump according to the present invention have several virtues, such like, lower cost, material save, easily maintaining, reliable operation, simple structure, high efficiency and the height of pumped water above 30 meters.

Although explanatory embodiments have been shown and described, it would be appreciated by those skilled in the art that changes, alternatives, and modifications can be made in the embodiments without departing from spirit and principles of the invention. Such changes, alternatives, and modifications all fall into the scope of the claims and their equivalents.

What is claimed is:

1. An improved jet well pump, comprising:

a centrifugal pump assembly (1) which is a centrifugal pump manufactured by stamping- welding;

a jet pump assembly (2);

said centrifugal pump assembly (1), comprising:

a pump body (11);

a pump cover (12) mounted into said pump body (11);

an impeller (13);

a shaft (14); and an electrical motor (15) arranged outside the pump body (11);

said impeller (13) is mounted on said shaft (14) and driven by said motor (15);

said jet pump assembly (2), comprising:

a jet pump body (21);

a nozzle (22) mounted in said jet pump body (21); and a throat part (23) disposed on the upper end of said jet pump body (21);

said centrifugal pump assembly (1) and said jet pump assembly (2) communicated with each other by means of an inlet pipe (3) and a return pipe (4), upper ends of said inlet pipe (3) and the return pipe (4) connected with an inlet (111) and an outlet (112) that are arranged on an axial surface of the pump body (11) respectively, and lower ends of said inlet pipe (3) and the return pipe (4) connected with said throat part (23) and said jet pump body (21) respectively, a radial shape of said pump body (11) is a full spiral gradually increasing along with a radial-outward direction of fluid flow, a section plane of the radial shape is an isosceles trapezoid having a slope in smooth variety, an inclination of said isosceles trapezoid β increasing as a radial depth of said pump body increasing, with a range between 20° and 85°.

2. An improved jet well pump of claim 1, wherein a radial surface of said pump body (11) having a vertical outlet (113) connecting a start point with an end point of said spiral.

3. An improved jet well pump of claim 2, wherein a diameter of said outlet (112) less than or equal to a diameter of said vertical outlet (113), said diameter of said vertical outlet (113) less than or equal to a diameter of said inlet (111).

4. An improved jet well pump of claim 2, wherein said pump body (11) also having a water filling hole (114) disposed on a higher position than both of said inlet (111) and said outlet (112) and a water discharge hole (115) disposed on lower portion of said pump body (11).

5. An improved jet well pump of claim 3, wherein said pump body (11) also having a water filling hole (114) disposed on a higher position than both of said inlet (111) and said outlet (112) and a water discharge hole (115) disposed on lower portion of said pump body (11).

6. An improved jet well pump of claim 1, wherein said inlet (111) disposed in a center of said pump body's axial surface, said outlet (112) disposed between said inlet and edge of said axial surface and parallel with said inlet (111).

7. An improved jet well pump of claim 6, wherein the upper end of said return pipe (4) connected to said outlet (112) arranged on the axial surface of the pump body (11) by a mean of thread fit, the lower end of said return pipe (4) connected to a return hole (211) of said jet pump body (21) by a mean of thread fit; the upper end of said inlet pipe (3) connected to said inlet (111) arranged on the axial surface of the pump body (11) by a mean of thread fit, the lower end of said inlet pipe (3) connected to an upper end of said throat part (23) by a mean of thread fit.

8. An improved jet well pump of claim 6, wherein said outlet (112) disposed on an area between 90° and 270° of said spiral.

9. An improved jet well pump of claim 8, wherein said outlet (112) disposed on a 90° position of said spiral, a height of said position equaling to a height of said inlet (111).

10. An improved jet well pump of claim 9, wherein the upper end of said return pipe (4) connected to said outlet (112) arranged on the axial surface of the pump body (11) by a mean of thread fit, the lower end of said return pipe (4) connected to a return hole (211) of said jet pump body (21) by a mean of thread fit; the upper end of said inlet pipe (3) connected to said inlet (111) arranged on the axial surface of the pump body (11) by a mean of thread fit, the lower end of said inlet pipe (3) connected to an upper end of said throat part (23) by a mean of thread fit.

11. An improved jet well pump of claim 8, wherein the upper end of said return pipe (4) connected to said outlet (112) arranged on the axial surface of the pump body (11) by a mean of thread fit, the lower end of said return pipe (4) connected to a return hole (211) of said jet pump body (21) by a mean of thread fit; the upper end of said inlet pipe (3) connected to said inlet (111) arranged on the axial surface of the pump body (11) by a mean of thread fit, the lower end of said inlet pipe (3) connected to an upper end of said throat part (23) by a mean of thread fit.

12. An improved jet well pump of claim 1, wherein the axial plane of said pump body (11) is a spherical plane or a curved plane with a variable curvature.

13. An improved jet well pump of claim 1, wherein a bracket (16) for a seal ring of internal end of said inlet disposed in said pump body (11), an end of said bracket (16) fitted over and fixed on an internal end of said inlet (111), the other end of which fixed on an internal side of the axial surface of said pump body (11); a gland cover (17) arranged on the internal end of said inlet (111), a seal ring (18) disposed in said gland cover (17), a radial clearance between said seal ring (18) and a front cover of said impeller (13) is less than 0.3 mm.

14. An improved jet well pump of claim 1, wherein said impeller (13) comprising a front cover (131), a rear cover (132) and a spiral blade (133) disposed between said front cover and said rear cover, three of them manufactured from metal plates by stamping, and then welded together.

15. An improved jet well pump of claim 1 wherein said nozzle (22) having a cone shape whose peak is upward, a diameter of said nozzle gradually decreasing along with a direction of fluid flow.

16. An improved jet well pump of claim 15, wherein said jet pump assembly (2) comprising a bottom valve (24) provided on bottom of said jet pump body (21) and a filter (25) disposed on bottom of said bottom valve (24).

17. An improved jet well pump of claim 15, wherein said throat part (23) comprising a diversion portion(d), a first stabilizing pressure portion (a), a diffusion portion (b) and a second stabilizing pressure portion (c) which connected in turn, both lengths of said first stabilizing pressure portion (a) and said second stabilizing pressure portion (c) more than or equal to the internal diameters thereof, a angle of said diffusion portion a for enlarging pressure less than or equal to 10°.

18. An improved jet well pump of claim 17, wherein a front end of said nozzle (22) extending into said diversion portion (d) of said throat port (23), an axial distance between said nozzle and said first stabilizing pressure portion (a) less than or equal to the minimum diameter of said nozzle (22).

* * * * *

UNITED STATES PATENT AND TRADEMARK OFFICE

CERTIFICATE OF CORRECTION

PATENT NO. : 8,047,806 B2
APPLICATION NO. : 12/158874
DATED : November 1, 2011
INVENTOR(S) : Yuanmin Liang et al.

It is certified that error appears in the above-identified patent and that said Letters Patent is hereby corrected as shown below:

IN THE SPECIFICATION:

Column 3, line approximately 33, “portion a for” should be -- portion α for --

Column 5, line 3 “assembly land” should be -- assembly 1 and --

Column 6, line approximately 56 “portion a for” should be -- portion α for --

IN THE CLAIMS:

In column 10, line 16, claim 17, “portion a for” should be -- portion α for --

Signed and Sealed this
Seventeenth Day of January, 2012

David J. Kappos

David J. Kappos
*Director of the United States Patent and Trademark Office*